United States Patent [19]

Steinhage

[11] 4,319,135

[45] Mar. 9, 1982

[54] TARGET PLATE FOR THERMAL IMAGE CONVERSION

[75] Inventor: Peter-Wilhelm Steinhage, Wiesbaden, Fed. Rep. of Germany

[73] Assignee: Heimann GmbH, Fed. Rep. of Germany

[21] Appl. No.: 145,746

[22] Filed: May 1, 1980

[30] Foreign Application Priority Data

May 30, 1979 [DE] Fed. Rep. of Germany ..... 2922031

[51] Int. Cl.[3] ..... H01J 31/49

[52] U.S. Cl. ..... 250/332

[58] Field of Search ..... 250/330, 332, 334, 338, 250/349; 358/113

[56] References Cited

U.S. PATENT DOCUMENTS 3,919,555 11/1975 Singer ..... 250/332

4,119,852 10/1978 Rougeot ..... 250/330

FOREIGN PATENT DOCUMENTS 2223288 5/1972 Fed. Rep. of Germany .

1395741 5/1975 United Kingdom .

*Primary Examiner*—Alfred E. Smith

*Assistant Examiner*—Janice A. Howell

*Attorney, Agent, or Firm*—Hill, Van Santen, Steadman, Chiara & Simpson

[57] ABSTRACT

A target plate for converting information-carrying thermal radiation to a storable or visual form is a carrier comprising the conversion layer having a grid thereon formed by adjoining regular polygons the borders of which are defined by an array of holes in the conversion layer. The holes may be aligned points or rectangular slots, and are arranged in the conversion layer to minimize lateral thermal transfer within the conversion layer, thereby separating the conversion processes within the conversion layer and resulting in improved resolution of the converted image. For use in a pyroelectric thermal vidicon an electrode layer is applied to one surface of the target plate.

8 Claims, 4 Drawing Figures

TARGET PLATE FOR THERMAL IMAGE CONVERSION

BACKGROUND OF THE INVENTION

1. Field of the Invention

The present invention relates to target plates for use in converting information-carrying thermal radiation to storable or visual form, and in particular to such plates which have application in a thermal vidicon.

2. Description of the Prior Art

Several types of devices operating according to different physical principles are known for converting information-carrying thermal radiation into storable or visual form. Such devices have in common the utilization of a physical conversion effect which transforms impinging thermal radiation into a locally distributed pattern which produces an image corresponding to the location and intensity of the thermal radiation.

The material in which the physical conversion effect takes place is generally referred to as the conversion layer, and in many devices the conversion layer takes the form of a plate on which thermal radiation impinges. In many applications, the conversion layer or conversion plate is comprised of pyroelectric material which generates a charge image consisting of locally distributed electrical charge which charge image is then utilized to generate a visual or storable image by scanning the surface of the plate with an electron beam. Other devices make use of a thermally generated voltage pattern or gradient opposite a base electrode, or make use of the thermoresistive effect to generate a locally distributed pattern of electrical resistance. Finally, some devices utilize the impinging radiation to generate a pattern of varying optical indices of refraction in an appropriate layer adjacent to the conversion plate. The particular physical effect and structure utilized to generate the visual or storable image may be selected depending upon individual needs and conditions associated with a particular application.

Each of the above-described conventional structures for converting thermal radiation into visual or storable form has a limited resolution capability resulting from the lateral transfer of thermal radiation within the conversion layer. By lateral transfer is meant radiation of thermal energy in a direction in the conversion layer perpendicular to the direction of the impinging thermal radiation. This transfer results from the heat transfer properties inherent in the conversion layer, which heat transfer proceeds according to an exponential function. In order to achieve a recognizable or storable image, two competing physical effects must be accommodated. First, the conversion layer must be exposed to the impinging thermal radiation for a sufficient amount of time so that the associated temperature gradient can be generated within the conversion layer to produce an image of sufficient intensity. This is contrasted with the fact that the sharpness of the image so generated is directly determined by the lateral thermal transmission within the conversion layer which lateral thermal transmission increases with increased exposure to the impinging radiation. Best resolution is obtained when the discrete local distributions of thermal conversion exist only for a brief time, so that the discrete distributions are not permitted to merge due to lateral thermal transmission and thereby blur the composite image.

A conversion plate structure for decreasing the lateral thermal transmission and thus increasing the optical resolution of the produced image in devices of the type initially described is disclosed in German OS No. 22 23 288. The structure disclosed therein is a conversion layer in a raster form applied to a supporting substrate, which raster consists of discrete blocks of detector elements of pyroelectric material. The conversion layer thereby consists of a mosaic of pyroelectric elements which are separated from one another by a network of channels. Inductive transmission between the discrete elements is thus reduced, resulting in a more highly resolved composite image. This structure has the disadvantage of requiring a carrier plate to support the individual pyroelectric elements. The carrier plate itself has an unavoidable thermal capacity which decreases the sensitivity of the applied conversion layer. Moreover, mechanical stability is a problem in the structure disclosed in German OS No. 22 23 288. because the discrete pyroelectric elements must be applied to the carrier with some form of supporting film or adhesive material which further impairs the sensitivity and resolution of the raster.

SUMMARY OF THE INVENTION

It is an object of the present invention to provide a target plate for use in thermal image conversion devices which results in improved resolution of the composite converted image in a simple and inexpensive manner.

It is a further object of the present invention to provide such a target plate in which the thermal conversion is undertaken which is independently mechanically stable so that the application or use of a separate carrier plate is not necessary.

The above objects are inventively achieved in a target plate in which a grid is formed by holes or slots in the conversion layer which are separated from one another and which are arranged in a network or array of regular polygons.

The conversion layer formed thereby is thus a connected body with sufficient mechanical stability and resistance to breaking for most applications, and such stability is achieved without the use of a separate carrier plate and associated adhesives which impair the resolution capabilities of conventional structures.

As stated, the apertures in the conversion layer may be point-form holes or rectangular slots. The selection of aperture shape and placement allows suppression of lateral thermal conductivity to meet the particular needs of a specific application. Moreover, the apertures may extend completely through the conversion layer, or may terminate within the layer if a greater degree of mechanical stability is required.

One arrangement of the apertures is that of aligning the apertures in perpendicularly intersecting lines with the points of intersection of such lines being nodes formed of conversion layer material.

In another form of grid arrangement, utilizing rectangular slots, each slot forms one side of two adjacent polygons, with the spaces between slots in a particular line being partially occupied by a slot in a line perpendicular to the first line of slots.

The above-described target plate has a particularly advantageous application in devices in which an electronic readout of the thermal image is undertaken. Such devices require a continuous signal electrode. An example of such a device is a pyroelectric camera tube or vidicon in which the apertured side of the target plate faces the incident thermal radiation and the opposite side of the target plate faces a scanning electron beam. For this application the embodiment in which the apertures do not extend completely through the conversion layer is most advantageous. The apertures may then be very narrow because they will not be seen by the electron beam, which sees only a continuous surface of the conversion layer.

In conventional target plates of the type described in German OS No. 22 23 288, application of a continuous signal electrode to the target plate could be achieved only with substantial difficulty and expense due to the continuous uninterrupted channels formed by the individual conversion elements. The present invention in which the thermal target plate is comprised of a continuous body lends itself to simplified application of a one-piece conductive electrode layer by numerous plating methods known in the art.

DESCRIPTION OF THE PREFERRED EMBODIMENTS

Figure 1:
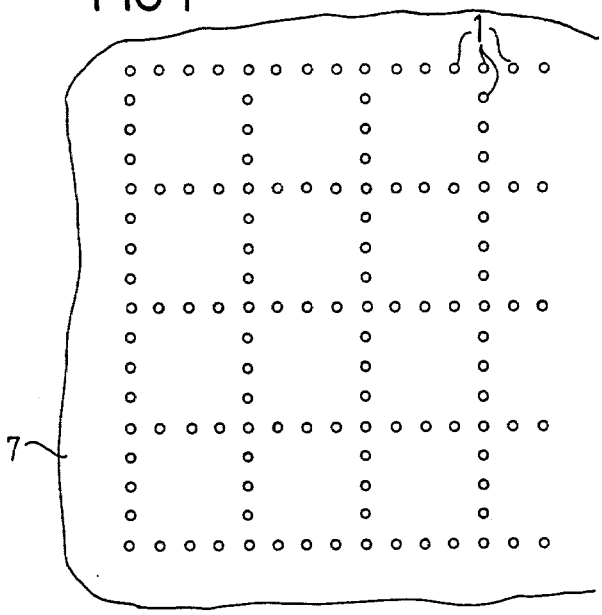
FIG. 1. is a plan elevational view of a portion of a thermal target plate constructed in accordance with the principles of the present invention having a grid of point-form holes therein.

As shown in FIG. 1, a portion of a thermal target plate 7 has a grid arrangement of point-form holes 1 therein, with the holes 1 arrayed in intersecting lines to define a plurality of adjacent regular polygons comprised of conversion layer material. The plate 7 may consist, for example, of pyroelectric triglycine sulfate monocrystal. Although the polygons shown in FIG. 1 are squares, it will be understood that any grid arrangement of holes 1 may be utilized which results in a plurality of adjacent regular polygons, according to particular application needs.

The holes 1 in the conversion layer plate 7 limit the lateral conductivity within the plate 7 of thermal radiation which impinges on the plate 7 in a direction perpendicular to the plane of the page. For example, a reduction of the lateral thermal conductivity of 40% can be achieved in the grid arrangement shown in FIG. 1 when the holes 1 are approximately 5 μm in diameter and the spacing between the holes 1 is approximately 4 μm.

Figure 2:
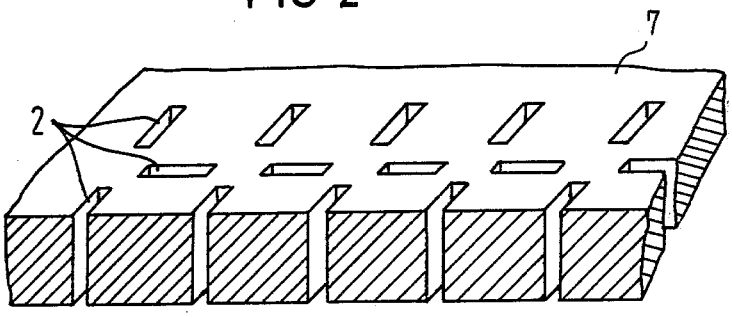
FIG. 2. is a perspective view, partly in section, of a portion of a thermal target plate constructed in accordance with the principles of the present invention having an array of rectangulr slots therein extending completely through the target plate.

A second aperture arrangement is shown in FIG. 2 in which the plate 7 has a plurality of aligned rectangular slots 2 therein, the slots 2 extending completely through the plate 7. The slots 2 are aligned in intersecting rows and columns with points of intersection between the rows and columns being nodes comprised of conversion layer material. In the embodiment shown in FIG. 2, a reduction of the lateral thermal conductivity of 80% can be achieved utilizing slots 2 having dimensions of 5 μm by 50 μm with a spacing of approximately 5 μm between the slots.

In both of the grid arrangements shown in FIGS. 1 and 2, the target plate 7 is comprised totally of conversion layer material and forms a connected body having substantial mechanical stability as an independent structure, without the need for a supporting carrier plate.

Figure 3:
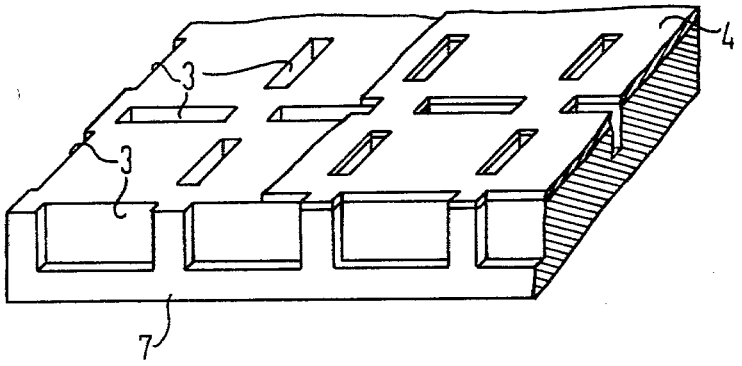
FIG. 3. is a perspective view, partly in section, of a portion of a thermal target plate constructed in accordance with the principles of the present invention having an array of rectangular slots partially extending therethrough and a continuous electrode applied thereto.

A particularly advantageous embodiment for use in pyroelectric vidicons is shown in FIG. 3 in which the target plate 7 is provided with rectangular slots 3 arranged indentically to the slots 2 in FIG. 2, however, the slots 3 do not extend completely through the plate 7, but terminate within the plate 7 forming recesses therein. The plate 7 is covered with a continuous electrically conductive layer 4 which is permeable to thermal radiation. The plate 4 may be comprised, for example of chrome-nickel or titanium and serves as a signal electrode to which a constant voltage is applied in the vidicon. The opposite face of the plate 7 is thus continuous and faces the scanning electron beam for electronic pickup of the locally distributed thermal gradient in the plate 7.

Figure 4:
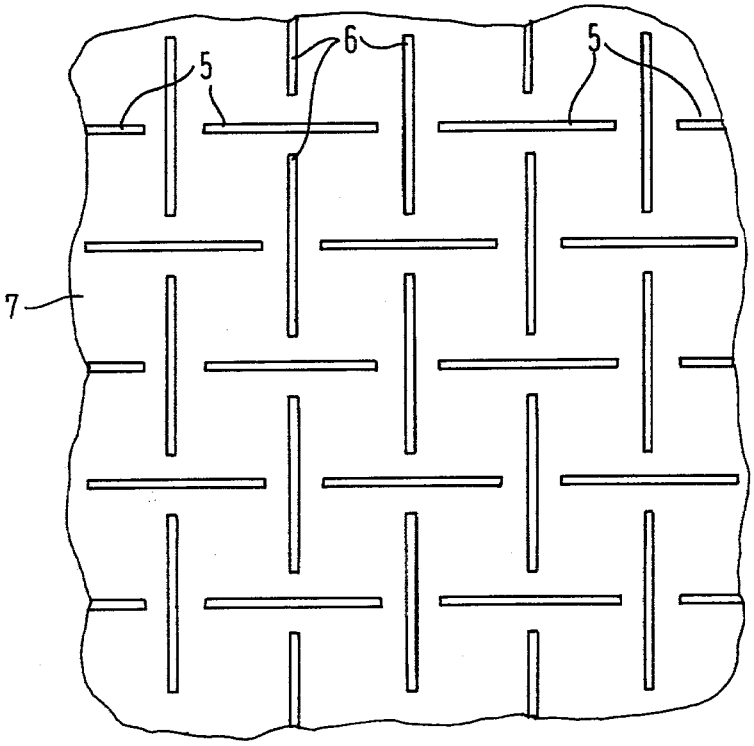
FIG. 4 is a plan elevational view of a portion of a target plate constructed in accordance with the principles of the present invention showing a second embodiment of rectangular slot arrangement.

A further grid arrangement is shown in FIG. 4, consisting of rows of horizontal rectangular slots 5 and columns of vertical rectangular slots 6. As in the embodiments shown in FIGS. 1 and 2, the intersecting rows and columns form the boundaries for a plurality of adjoining regular polygons comprised of conversion layer material. In the embodiment of FIG. 4, however, each slot 5 or 6 forms one side of two such polygons with the spaces between slots in a particular row or column being partially occupied by a perpendicularly disposed slot. Lateral thermal conductivity is substantially suppressed by the embodiment shown in FIG. 4, and in particular, diagonal thermal conduction is practically eliminated. The suppression of lateral thermal conductivity is achieved, however, with retention of substantial mechanical stability in the target plate 7.

Although modifications and changes may be suggested by those skilled in the art, it is the intention of the inventor to embody within the patent warranted hereon all changes and modifications as reasonably and properly come within the scope of his contribution to the art.

I claim as my invention:

1. A thermal image target plate for converting information-carrying thermal radiation impinging on a side of said plate into a locally distributed pattern on said plate, said target plate comprising:

a conversion layer having a plurality of recesses therein extending through said conversion layer, said recesses disposed in a network of lines forming the sides of a plurality of regular polygons and being separated from one another by areas of said conversion layer, said recesses disposed so as to prevent lateral thermal conductivity in said conversion layer and blurring of said pattern associated with said lateral thermal conductivity; and an electrically conductive layer forming a signal electrode on said side of said target plate facing said impinging thermal radiation.

2. The target plate of claim 1 wherein said recesses are rectangular slots.

3. The target plate of claim 2 wherein said areas of said conversion layer separating said slots are shared by at least two lines of said slots in said network.

4. The target plate of claim 2 wherein said slots are disposed in a plurality of perpendicular rows and columns with slots in said columns being disposed in said areas of conversion layer between slots in said rows.

5. The target plate of claim 1 wherein said recesses extend partially through said target plate, whereby a side of said target plate facing said thermal radiation is a continuous unbroken surface.

6. The target plate of claim 1 wherein said target plate is comprised of pyroelectric material.

7. The target plate of claim 1 wherein said target plate is comprised of thermoresistive material.

8. The target plate of claim 1 wherein said recesses are point-form holes extending through said target plate.

* * * * *